United States Patent [19]

Miller et al.

[11] 4,108,581

[45] Aug. 22, 1978

[54] SUSPENSION SYSTEM FOR MOTOR-COMPRESSOR UNIT

[75] Inventors: Kenneth H. Miller, Syracuse; Tadek M. Kropiwnicki, W. Syracuse, both of N.Y.

[73] Assignee: Carrier Corporation, Syracuse, N.Y.

[21] Appl. No.: 708,519

[22] Filed: Jul. 26, 1976

[51] Int. Cl.[2] ..... F04B 17/00; F16F 15/00

[52] U.S. Cl. ..... 417/363; 417/902; 248/15; 248/21

[58] Field of Search ..... 417/363, 902; 248/15, 248/21, 22, 20; 310/51, 91; 62/295

[56] References Cited

U.S. PATENT DOCUMENTS

| | | | |
|---|---|---|---|
| 1,823,555 | 9/1931 | Naul | 248/21 |
| 2,272,099 | 2/1942 | Smith | 62/295 |
| 3,052,435 | 9/1962 | Roller | 248/21 |
| 3,250,461 | 5/1966 | Parker | 417/363 |
| 3,317,121 | 5/1967 | DeGroat | 417/363 |
| 3,849,028 | 11/1974 | Kurita | 248/15 |
| 3,887,303 | 6/1975 | Matsuzaka et al. | 417/363 |
| 3,949,878 | 4/1976 | Tuthill | 248/22 |

FOREIGN PATENT DOCUMENTS

| | | | |
|---|---|---|---|
| 772,419 | 4/1957 | United Kingdom | 248/21 |

*Primary Examiner*—Carlton R. Croyle
*Assistant Examiner*—Thomas I. Ross
*Attorney, Agent, or Firm*—J. Raymond Curtin; Barry E. Deutsch

[57] ABSTRACT

A suspension system for a motor-compressor unit suspended within a hermetically sealed shell includes a plurality of rigid anchoring members secured to the motor-compressor unit at approximately the center of gravity of the mass defined thereby and to a connecting member permanently secured to the shell. Individual springs are attached to each of the anchoring members for yieldably suspending the motor-compressor unit within the shell. A retainer member is provided in spaced relation to each of the anchoring members. A resilient member is disposed in the space defined between the anchoring member and retaining member and is slightly under compression when the motor-compressor unit is at rest. The resilient member is further compressed to limit motion of said motor-compressor unit in a vertical direction, and in an angular direction about the horizontal and vertical axes of said unit.

1 Claim, 3 Drawing Figures

SUSPENSION SYSTEM FOR MOTOR-COMPRESSOR UNIT

BACKGROUND OF THE INVENTION

This invention relates to a suspension system for a hermetically sealed motor-compressor unit.

The desirability of having an efficient suspension system for a hermetically sealed motor-compressor unit of the type particularly employed in a mechanical refrigeration unit is well known to those skilled in the art. Such suspension systems have two primary functions.

First, the suspension system is intended to isolate the internal compressor-motor unit from the shell which surrounds the same to prevent the transmission of noise to the shell and then from the shell to the outer environment. Secondly, the suspension system should be designed to prevent damage to the internal motor-compressor unit.

During normal operation of a motor-compressor unit, it is generally subjected to severe stress or mechanical shocks only during start-up of the machine. During start-up, the torsional forces generally produce angular or rotational movement of the motor-compressor unit in a direction about the vertical axis of the unit.

While the unit is being shipped from the manufacturer to its point of installation, the unit may also be subjected to severe stresses due to handling which will cause the unit to oscillate quite extensively in its shell making the various parts of the unit, such as the windings of the motor, the lubrication oil pump, and the discharge tube, subject to damage. Generally, the nature of the motion produced as a result of such handling is complex, resulting in the motor-compressor unit moving in a vertical direction or in an angular or rotational direction relative to the horizontal axis of the motor-compressor unit, or to a combination thereof. In either case, however, damage may occur to the various components of the unit unless such movement is significantly limited by the suspension system. In addition, the metal-to-metal contact resulting from such movement generally causes chips of metal to develop in the oil sump. Such chips might then become entrained in the oil with resulting damage to the lubricating system components and bearings.

Various types of suspension systems have heretofore been employed to effectively limit the movement of the motor compressor unit within the shell.

Generally, sets of springs are employed at or near the center of gravity of the mass defined by the motor-compressor unit to achieve optimum vibration isolation. Since the motor-compressor unit mass is supported at its plane of least motion, i.e. the center of gravity, some problems have occurred as a result of the impact between components, since excessive motion occurs at the extreme ends of the motor-compressor unit when the unit is moving in a generally angular direction relative to the horizontal plane of the unit. Typically, motion limiting means have been provided in strategic locations to prevent excessive motion at the extreme ends of the unit. An example of prior art suspension systems is disclosed in U.S. Pat. No. 3,689,207, wherein a cup-shaped member has a vertically extending foot movably positioned therein to prevent excessive movement of the unit in an angular direction relative to the horizontal plane of the unit.

Another suspension system heretofore commercially employed includes a bumper suitably attached to a vertical extension of the compressor shaft. A cup or similar member is provided in spaced relation to the bumper to prevent undesired excessive movement in an angular direction relative to the horizontal axis of the motor-compressor unit. This suspension system also includes springs to prevent excessive downward movement in a vertical direction. An elastomeric shock absorber is provided to prevent the starting torsional forces from producing metal-to-metal contact and subsequent high impact forces, between a connecting ring and anchoring bolts passing through holes provided therethrough.

The suspension system described hereinabove has proven to be effective; however, the system must permit wide fabricating and assembly tolerances to accommodate the various components of the suspension system which result in an excessive space allowance within the shell. By increasing the space within the shell, additional impact and rebound forces are generated which may increase the possibility of damage to the components of the motor-compressor unit causing a concurrent increase in reliability problems. In addition, the use of a separate bumper and associated cup have resulted in increased costs in manufacturing the unit.

SUMMARY OF THE INVENTION

An object of this invention is a compact, inexpensive and efficient suspension system for a hermetically sealed motor-compressor unit.

It is a further object of this invention to eliminate the necessity of having separate shipping stops and to incorporate the function thereof into other components of the suspension system.

A further object of this invention is a suspension system for a hermetically sealed motor-compressor unit which effectively limits movement of the unit in a vertical direction, and in angular directions about the horizontal and vertical axes of the unit.

These and other objects of the present invention are attained in a suspension system for a hermetically sealed motor-compressor unit including a plurality of rigid anchoring members secured to the unit at approximately the center of gravity of the mass defined thereby. A connecting member is permanently secured to the shell. Anchoring members secure the motor-compressor unit to the connecting member. Individual springs are attached to each of the anchoring members for yieldably suspending the motor-compressor unit to the connecting member. A retaining member is provided in spaced relation to each of the anchoring members. A resilient member is disposed in the space defined between the anchoring member and retaining member and is slightly under compression when the motor-compressor unit is in a static state. The resilient member is further compressed to limit motion of said motor-compressor unit in a vertical direction, and in angular directions about the horizontal and vertical axes of said unit.

DESCRIPTION OF THE PREFERRED EMBODIMENT

Figure 1:
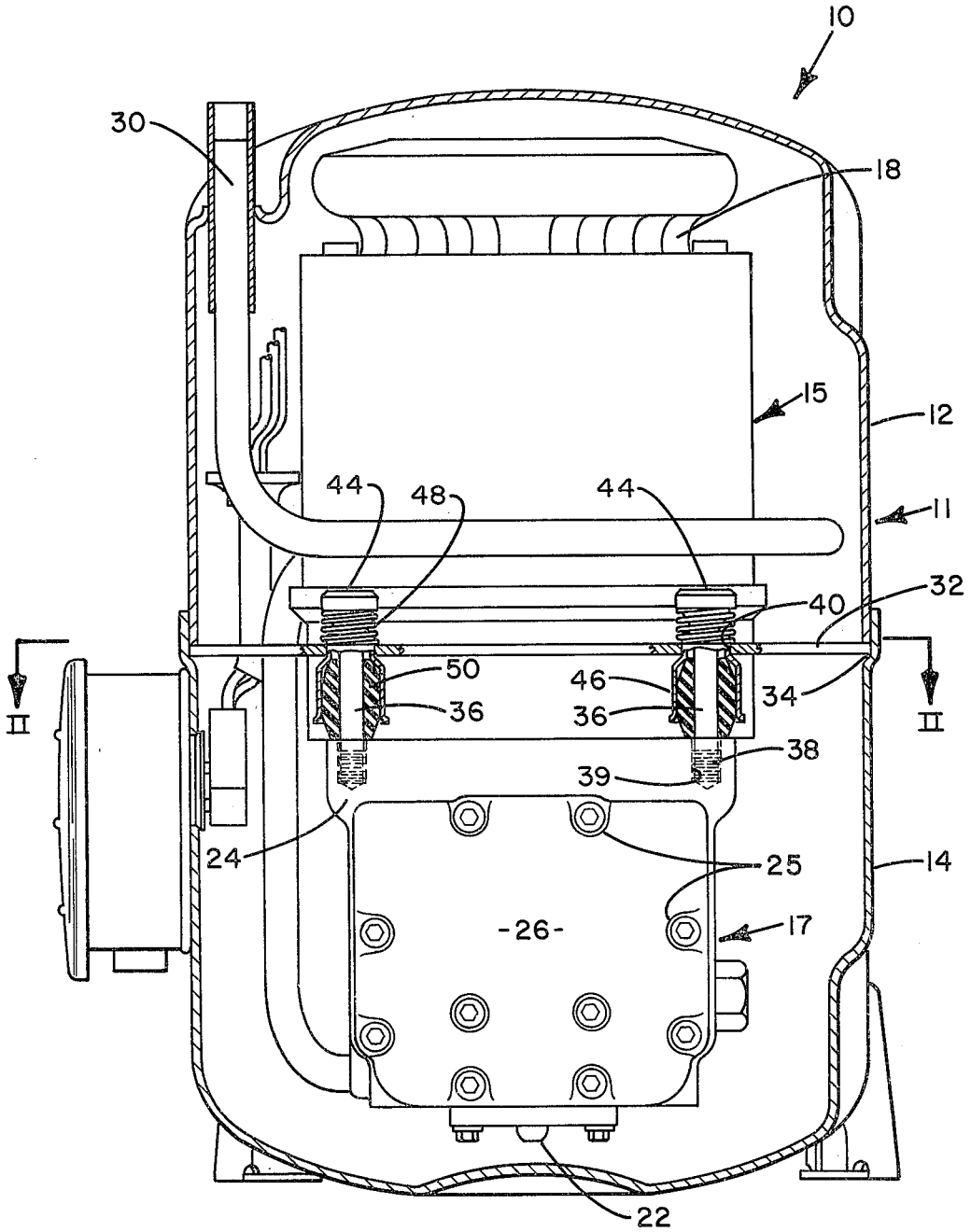
FIG. 1 is a longitudinal sectional view of a hermetically sealed motor-compressor unit embodying the suspension system of the present invention.

Referring to the drawings, there is shown a hermetically sealed motor-compressor unit embodying the novel suspension system in accordance with this invention. The motor-compressor unit disclosed herein may be employed in a mechanical refrigeration unit of a type well-known to those skilled in the art.

Figure 2:
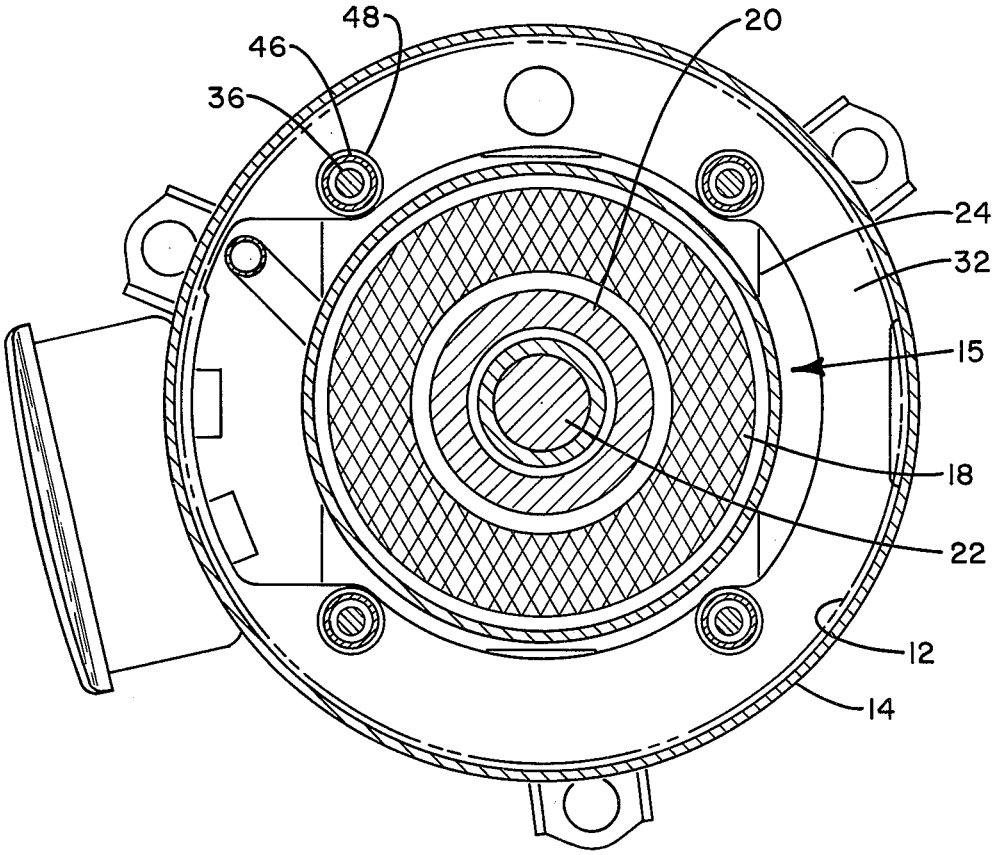
FIG. 2 is a sectional view taken along the line II—II of FIG. 1.
Figure 3:
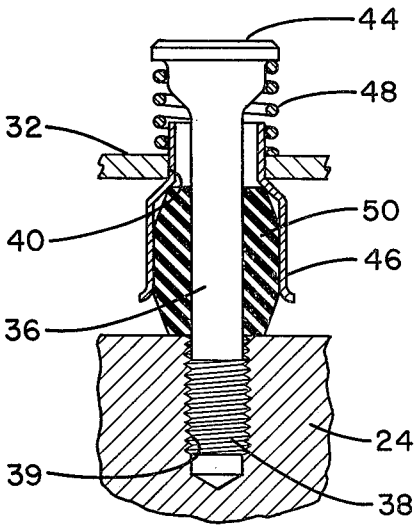
FIG. 3 is a sectional view of a detail disclosing features of the present invention.

Referring particularly to FIGS. 1 and 2, the hermetically sealed motor-compressor unit is generally indicated at 10. The unit is housed within a shell generally indicated at 11 having a somewhat elliptical cross-sectional shape. Shell 11 is fabricated of a lower shell section 14 and an upper shell section 12 which are welded together. An electric motor generally indicated at 15 and a compressor generally indicated at 17 are disposed within shell 11. Compressor 17 is axially aligned with motor 15 and is disposed therebelow.

Motor 15 includes stator 18 and rotor 20, the rotor being operably connected to drive crankshaft 22 of the compressor. The crankshaft is supported within cylinder block 24 of compressor 17.

The cylinder block defines the cylinders (not shown) of the compressors. A cylinder head 26 is secured to an end of cylinder block 24 by suitable means, for example screws 25, to enclose the end of the cylinder. As is well known to those skilled in the art, pistons are disposed within the cylinders for reciprocal movement therein. Any desired number of cylinders may be employed. Connecting rods and wrist pins of the type well known to those skilled in the art, typically connect the pistons to the eccentric portion of crankshaft 22. The desired reciprocating movement of the pistons is obtained by rotation of the crankshaft as is obvious to those skilled in the art.

The hermetically sealed motor-compressor unit embodying the invention is typically employed in a mechanical refrigeration unit. The refrigerant gas to be compressed, enters into the shell of the compressor and thereafter flows over the rotor and stator windings of motor 15 to cool the same.

The refrigerant gas thereafter enters the compressor portion of the unit via suitable suction openings which may be disposed in cylinder head 26.

The refrigerant gas is thence compressed by operation of the piston in the cylinders, is discharged from the cylinders and thence flows into a discharge line 30 which connects with a discharge outlet provided for transmitting the compressed gas to the other components of the refrigeration unit.

Various other features of the compressor, for example the valves, valve plates and lubrication system are standard within the art and a description of the details of same are not deemed necessary.

The suspension system in accordance with the instant invention includes suitable means which may be permanently secured to the shell 11 for a reason to be described hereinafter. As illustrated, such means may include a donut shaped ring 32 which is seated on an inwardly facing lip or flange 34 formed at the upper portion of lower shell section 14. Ring 32 seats on the lip and once upper shell section 12 is placed within the lower shell and permanently secured thereto, the ring is permanently affixed in position. Ring 32 may be replaced by other suitable means, as for example brackets.

The suspension system further includes rigid anchoring means, illustrated as bolts 36. Bolts 36 are connected to the motor-compressor unit at the center of gravity of the mass defined thereby to achieve optimum vibration isolation. The bolts preferably have threaded portions 38 at their lower ends, the threaded portions being received within suitable threaded holes 39 formed in the upper surface of the cylinder block. Ring 32 has suitable holes 40 formed therein; these holes are placed in vertical alignment with holes 39 formed in the upper surface of the cylinder block to permit the rigid anchoring bolts 36 to be threadably received within the holes.

Rigid anchoring means 36 further include an enlarged head portion 44 which is spaced from the upper surface of ring 32. Spring means 48 is provided between the head and the upper surface of the ring for yieldably suspending the motor-compressor unit within the shell. The springs function to yieldably connect the motor-compressor unit, via bolts 36, to ring 32.

The suspension system further includes a retaining member 46, shown as an inverted cup-shaped member, which is secured by suitable means, as for example welding, to ring 32. The retaining member is provided in spaced apart relation to the lower section of the bolts 36. A resilient member, such as shock absorber 50, is provided in the annular space defined between the opposed surfaces of anchoring means 36 and retaining member 46 to substantially fill this space. Preferably, the member may be under a slight state of compression when the motor-compressor unit is at rest or in a static condition. The resilient member is preferably formed from an elastomeric material, such as black neoprene of 62–70 durometer. This material provides sufficient resiliency for the elastomeric member to function in a desired manner, yet retains sufficient structural strength for durability.

Motor-compressor units of the type disclosed may be subjected to severe shocks during shipping. In addition, the motor-compressor unit is subjected to torsional forces when the unit is started. Such shocks or torsional forces have a tendency to cause the motor-compressor unit to vibrate within the shell. It is one of the primary functions of the suspension system to prevent damage to the components, as for example the motor windings and discharge line of the motor-compressor unit, when the unit is vibrating due to shipping shocks or starting forces. In addition, the suspension system should minimize the noise transmitted to the shell.

The suspension system of the present invention prevents damage to the components of the motor-compressor unit by limiting the movement of the motor-compressor unit when subjected to shipping shocks or starting forces. If the forces developed by such shocks have a tendency to move the motor-compressor unit vertically upward or downward, the elastomeric resilient member 50 will be compressed between the opposed surfaces of cup 46 and block 24. As member 50 is compressed, it is obvious that the force required to achieve further movement of the motor-compressor unit must be increased to overcome the force generated as a result of the compression of member 50. In essence, the force thus generated opposes further movement of the motor-compressor unit. Member 50 is designed to achieve its maximum compression to prevent any further movement of the motor-compressor unit either vertically upward or downward before springs 48 are stretched beyond their yield point. Thus, by substantially filling the entire space defined between retaining member 46 and anchoring means 36, the movement of the motor-compressor unit either vertically upward or downward is limited.

In addition, the substantially complete occupation of the space defined between the opposed surfaces of members 36 and 46 by resilient member 50 achieves motion limiting functions in an angular direction. For example, during starting operations the motor-compressor unit is generally subjected to torsional forces having a tendency to oscillate the motor-compressor unit about its vertical axis. Resilient member 50 will be compressed between the opposed surfaces of members 36 and 46 as a result of such angular or rotational movement. The force generated as a result of the compression of member 50 will thereby limit such movement. In addition, if the motor-compressor unit is subjected to forces tending to oscillate or rotate the unit about its horizontal axis, again resilient members 50 will be compressed to limit this motion. If this motion occurs, resilient members 50 are compressed between the opposed surfaces of retainer cup 46 and cylinder block 24, as well as between the opposed surfaces of anchoring means 36 and retaining member 46. Thus, by providing a resilient member which substantially occupies the space defined between anchoring means 36 and retainer 46, a suspension system having motion limiting means in all directions is provided. Such suspension system eliminates various components required in systems of the aforedescribed prior art, thereby reducing the cost thereof, while improving the reliability of said suspension system.

While a preferred embodiment of the instant invention has been described and illustrated, the invention should not be limited thereto, but may be otherwise embodied within the scope of the following claim.

We claim:

1. In a suspension system for mounting a motor-compressor unit within a hermetically sealed shell, the improvement comprising:

connecting means permanently secured to said shell;

anchoring means secured to said motor-compressor unit at approximately the center of gravity of the mass defined by said unit, including a plurality of rigid members spaced about a selected surface of said compressor of said unit;

individual spring means attached to each of said anchoring means and supported by said connecting means for yieldably suspending said unit within said shell;

a separate retaining member provided in spaced relation to each of said anchoring means; and a resilient member disposed in said space between said retaining member and said anchoring means to substantially occupy the whole of said space when said motor-compressor unit is in a static state, the inner surface of said resilient member being in intimate contact with the outer surface of said anchoring means, and the outer surface thereof being in contact with the inner surface of said retaining member, whereby said resilient member will be compressed between the opposed surfaces of said anchoring means and said retaining member to limit any motion of said motor-compressor unit in an angular direction about the horizontal axis of said unit, will be further compressed between opposed surfaces of said motor-compressor unit and said retaining member to limit motion of said motor-compressor in either vertically upward or downward directions within said shell, and will be further compressed between opposed surfaces of said anchoring means and said retaining member, and said retaining member and said motor-compressor unit to limit motion of said unit about the vertical axis of said unit.

* * * * *